US008919054B2

(12) United States Patent
Tillery et al.

(10) Patent No.: US 8,919,054 B2
(45) Date of Patent: Dec. 30, 2014

(54) LAYERED FLOOR TILE CONNECTABLE TO FORM AN AREA MAT THAT RESISTS DELAMINATION FROM SCUFFING

(75) Inventors: William Leon Tillery, Ringgold, GA (US); Walter Robb Andersen, Dalton, GA (US)

(73) Assignee: MMI Andersen Company, LLC, Dalton, GA (US)

( * ) Notice: Subject to any disclaimer, the term of this patent is extended or adjusted under 35 U.S.C. 154(b) by 0 days.

(21) Appl. No.: 13/464,341

(22) Filed: May 4, 2012

(65) Prior Publication Data

US 2013/0291457 A1 Nov. 7, 2013

(51) Int. Cl.
*E04F 11/16* (2006.01)
*E01C 13/04* (2006.01)

(52) U.S. Cl.
CPC ..... *E04B 15/02* (2013.01); *E01C 13/045* (2013.01)
USPC ..... 52/177; 52/181

(58) Field of Classification Search
USPC ..... 52/177, 181, 302, 591, 591.1
See application file for complete search history.

(56) References Cited

U.S. PATENT DOCUMENTS

| | | | | |
|---|---|---|---|---|
| 3,172,343 | A * | 3/1965 | Jacobs | 428/600 |
| 4,087,948 | A * | 5/1978 | Mellor | 52/180 |
| 4,133,481 | A * | 1/1979 | Bennett | 238/14 |
| 4,287,693 | A * | 9/1981 | Collette | 52/177 |
| 4,361,614 | A * | 11/1982 | Moffitt, Jr. | 428/138 |
| 5,052,158 | A * | 10/1991 | D'Luzansky | 52/177 |
| 6,526,705 | B1 * | 3/2003 | MacDonald | 52/177 |
| 6,802,159 | B1 * | 10/2004 | Kotler | 52/177 |
| 6,966,155 | B2 * | 11/2005 | Nevison | 52/177 |
| 7,114,298 | B2 * | 10/2006 | Kotler | 52/177 |
| 7,571,573 | B2 * | 8/2009 | Moller, Jr. | 52/177 |
| 7,690,160 | B2 * | 4/2010 | Moller, Jr. | 52/177 |
| 7,698,859 | B2 * | 4/2010 | Sansano Marti | 52/177 |
| 7,797,890 | B2 * | 9/2010 | Thrush et al. | 52/177 |
| D653,893 | S * | 2/2012 | Huss et al. | D6/582 |
| 8,166,722 | B2 * | 5/2012 | Moller, Jr. | 52/588.1 |
| 2007/0289244 | A1 * | 12/2007 | Haney et al. | 52/539 |

OTHER PUBLICATIONS

Mountville Mills Anti-Fatigue Mat Collection, www.mountville.com/productcategory.aspx (Products, Anti-Fatigue Collection), Mountville Mills, Inc., 1729 S. Davis Road, LaGrange, GA 30241.

Anti-Fatigue Mat Materials on About.com Ergonomics, http://ergonomics.about.com/od/antifatiguemats/tp/Anti-Fatigue_Mat-Materials.htm, (2009).

Invigorator Anti-Fatigue Mat, matsmatsmats.com, http://www.matsmatsmats.com/commercial-industrial/anti-fatigue/invigorator-mat . . . (2 pages) (2000).

(Continued)

*Primary Examiner* — Basil Katcheves
(74) *Attorney, Agent, or Firm* — Baker Donelson Bearman Caldwell & Berkowitz PC

(57) ABSTRACT

A modular floor tile comprising a base substrate and top layer having a first land with a support surface and first and second perimeter portions each defining a second land with a surface recessed relative to the support surface, the first perimeter portion defining a recess and the opposing second perimeter portion defining a lug, whereby two tiles join together by the recess receiving a lug of a second tile, and the support surface supporting footwear remote from the second land to avoid scuffing against the joined lug and recess so the top layer is not delaminated from the base substrate.

6 Claims, 7 Drawing Sheets

(56) References Cited

OTHER PUBLICATIONS

Mountville Mills 2010 Catalog, Mountville Mills, Inc., 1729 S. Davis Road, LaGrange, GA 30241 (2010).

Anti-Fatigue Mats, matsmatsmats.com, http://www.matsmatsmats.com/commercial-industrial/anti-fatigue/invigorator-mat . . . (4 pages) (2000).

* cited by examiner

LAYERED FLOOR TILE CONNECTABLE TO FORM AN AREA MAT THAT RESISTS DELAMINATION FROM SCUFFING

FIELD OF THE INVENTION

The present invention relates to floor mats and particularly anti-fatigue mats. More particularly, the invention relates to layered floor tiles that connect together as modules to cover an area as a mat while resisting delamination of a top layer from a base substrate during use of the tile and to methods for forming a layered floor tile.

BACKGROUND OF THE INVENTION

Persons who have work or other needs for standing for long periods of time or for walking on hard floor surfaces such as concrete or tile often experience problems with their feet and with fatigue. To accommodate such work needs and assist with reducing fatigue from standing or walking on hard surfaces, anti-fatigue mats have been developed to provide a cushioned surface on which to stand or walk. There are various types of anti-fatigue mats, including foam, gel-filled, foam rubber, and hard rubber. Each type provides alternative benefits and features, but generally, each type of mat provides a cushioned or resilient body to soften the surface on which the person stands or walks. For small area workstations, for example, at a machinery control station or a photocopy machine, single small area mats are satisfactory. However, there are often needs to cover a larger areas, such as a small room or hallway.

Individual stations may use a foam mat or a gel mat. Foam mats are readily manufactured but provide moderate support and moderate anti-fatigue while gel-filled offer superior support and anti-fatigue benefits. Foam rubber mats are suitable for industrial applications. Hard rubber mats may have interlocking pieces to assemble as a runner or to cover a large area.

While hard rubber mats with interlocking features may connect together to cover a large area, such may be unsatisfactory as lacking anti-fatigue properties. Foam mats having a resilient or cushioned base and an overlaid attached rubber surface are readily manufactured but have the drawback of not interlocking together satisfactorily. Die cutting of such foam mat to form the connecting members on side edges causes cupping in the side walls, and thereby reduces the effectiveness of the connection between adjacent tiles. Scuffing of footwear or wheeled traffic may also cause the rubber layer to delaminate or separate from the foam base.

Accordingly, there is a need in the art for rubber/foam-backed anti-fatigue tiles that resist delamination of the rubber from the foam back during use of the tiles connected together as an anti-fatigue mat to cover an area. It is to such that the present invention is directed.

SUMMARY OF THE INVENTION

The present invention meets the need in the art by providing a floor tile, comprising a base substrate with a length and a width exceeding a depth and having a back surface and a top layer attached to the base substrate opposing the back surface. The top layer has a central portion and at least opposing first and second marginal perimeter portions. The central portion defines a land with a support surface. The first and second marginal perimeter portions each define a respective second land with a surface recessed relative to the support surface. Connector means for joining the first marginal perimeter portion of one of the floor tiles to the second marginal perimeter portion of an adjacent second one of the floor tiles, whereby the support surfaces of adjacent connected floor tiles supports footwear or wheeled traffic of a user thereon remote from the second land of the marginal perimeter portions to restrict the footwear or wheeled traffic from scuffing against the joined marginal perimeter portions of the adjacent joined floor tiles so that the top layer is not delaminated from the base substrate thereby.

In another aspect, the present invention provides a method for forming a floor tile, comprising the steps of:

(a) providing a base substrate with a length and a width exceeding a depth and having a back surface;

(b) forming a top layer to have a central portion and at least opposing first and second marginal perimeter portions, the central portion defining a first land with a support surface, the first and second marginal perimeter portions each defining a respective second land with a surface recessed relative to the support surface;

(c) attaching the layer to the base substrate opposing the back surface, (d) providing a connector for joining a plurality of the floor tiles join together at perimeter portions, whereby the support surfaces of adjacent connected tiles support footwear or wheeled traffic of a user thereon remote from the second land of the marginal perimeter portions to restrict the footwear or wheeled traffic from scuffing against the recessed second land so that the top layer is not delaminated from the base substrate thereby.

In yet another aspect, the present invention provides an area anti-fatigue mat, comprising a plurality of modular floor tiles that being joined together selectively cover an area larger than an individual one of the modular floor tiles. Each modular floor tile comprises a base substrate with a length and a width exceeding a base depth and having a back surface and a top layer attached to the base substrate opposing the back surface. The top layer has a central portion and at least opposing first and second marginal perimeter portions. The central portion defines a land with a support surface. The first and second marginal perimeter portions each define a respective second land with a surface recessed relative to the support surface. Connector means for joining the first marginal perimeter portion of one of the floor tiles to the second marginal perimeter portion of an adjacent second one of the floor tiles. The support surfaces support footwear or wheeled traffic of a user thereon remote from the second land of the marginal perimeter portions. This restricts the footwear or wheeled traffic from scuffing against the joined projecting lug and lug-receiving recess of adjacent joined floor tiles so that the top layer is not delaminated from the base substrate.

Objects, features and advantages of the invention will become more apparent upon a reading of the following detailed description in conjunction with the drawings and the claims.

DETAILED DESCRIPTION

Figure 1:
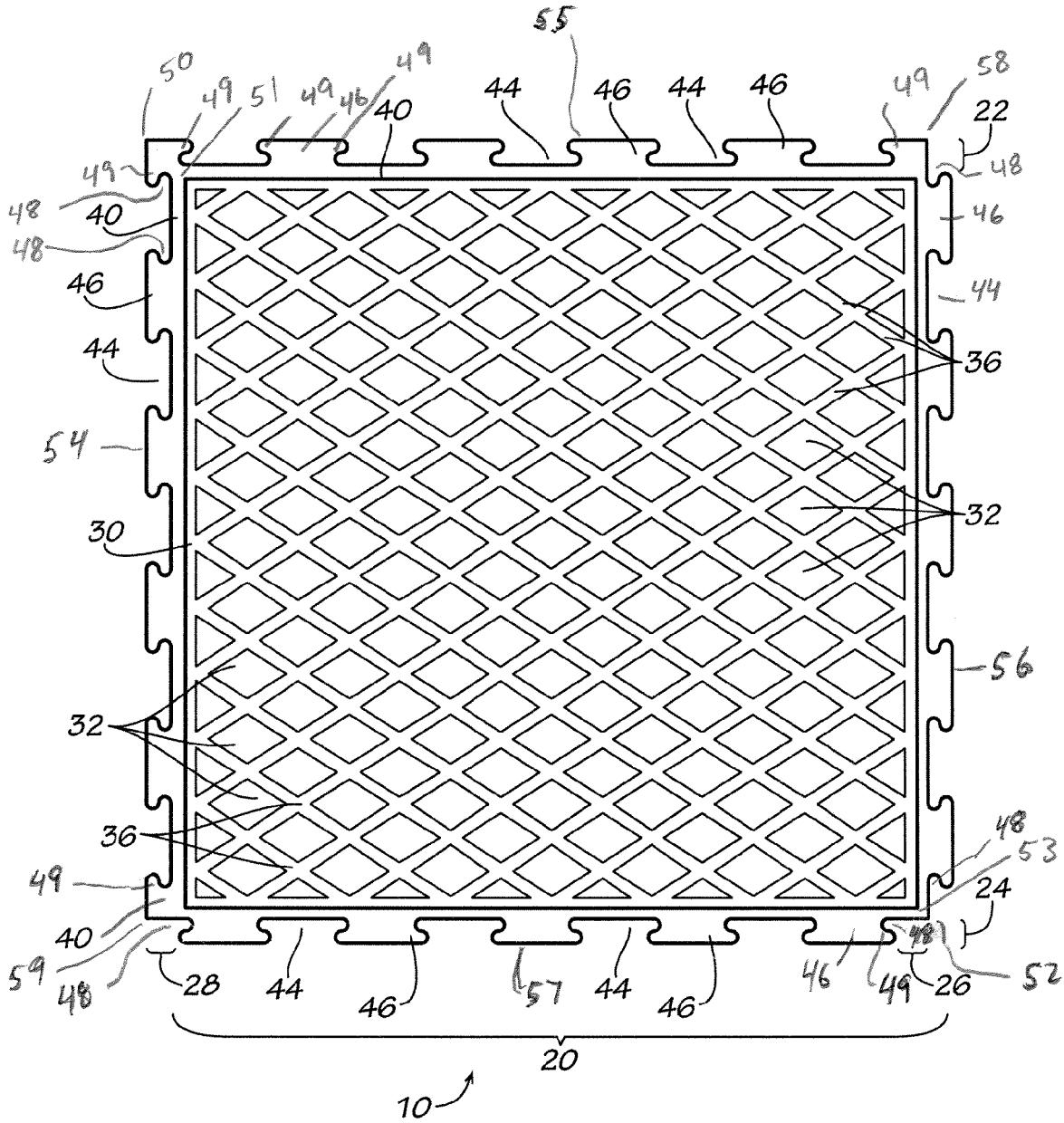
FIG. 1 illustrates in top plan view an embodiment of a modular floor tile in accordance with the present invention.
Figure 2:
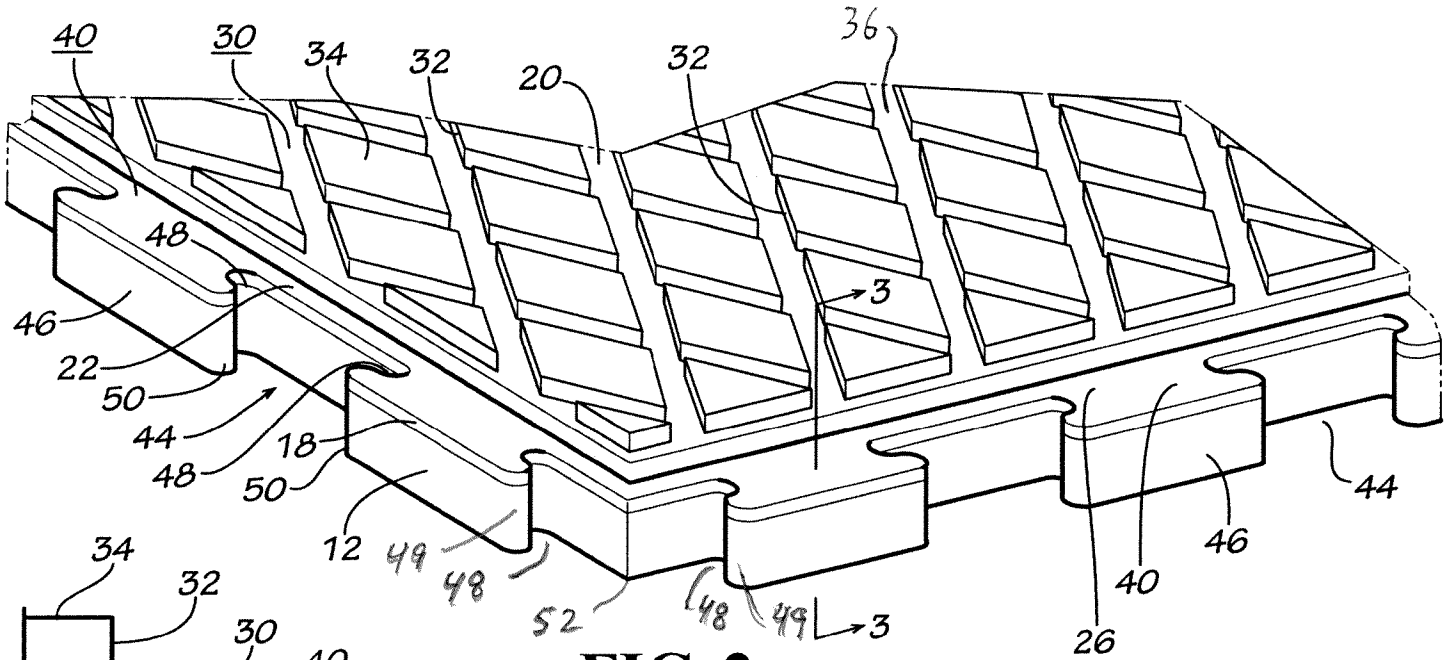
FIG. 2 illustrates a detailed perspective view of a portion of the modular floor tile shown in FIG. 1.

With reference now to the drawings, in which like parts have like identifiers, FIG. 1 illustrates in top plan view an embodiment of a layered floor tile 10 in accordance with the present invention. FIG. 2 illustrates a detailed perspective view of a portion of the tile 10. The tile 10 in the illustrated embodiment includes a foam substrate 12 with a length and a width that exceeds a foam depth 14 and having a back surface 16. A molded rubber layer 18 attaches, such as during vulcanization, to the foam substrate 12 opposing the back surface 16. The rubber layer 18 includes a central portion 20 and at least opposing first and second marginal perimeter portions 22, 24. The illustrated embodiment includes opposing third and fourth marginal perimeter portions 26, 28.

The central portion 20 defines a land 30. The land 30 has a support surface 34 for a purpose discussed below. In the illustrated embodiment, a plurality of spaced-apart cleats 32 extend upwardly to respective distal surfaces, that cooperatively define the support surface 34. As shown in FIG. 1, the spaced-apart cleats 32 define channels 36. The illustrated cleats 32 are diamond-shaped (for interior cleats and triangular for perimeter cleats), but may be configured as other shapes, such as squares, ovals, circles, lands, or other patterns, for defining the support surface for a purpose discussed below. In an alternate embodiment, the land 30 has a support surface not interrupted by channels 36. Alternatively, the support surface 34 may be textured, dimpled, corrugated, embossed, pebbled, defined with holes, ribs, have a grit-top, or raised cleat.

With continuing reference to FIGS. 1 and 2, the first and second marginal perimeter portions 22, 24 each define a respective second land 40 with a surface recessed relative to the distal support surfaces 34 of the cleats 32. In the illustrated embodiment, the first and second marginal perimeter portions each define matingly engageable connectors to join adjacent ones of the tiles together. In the illustrated embodiment, an edge of the first marginal perimeter portion 22 defines at least one lug-receiving recess 44. The illustrated embodiment includes a plurality of the lug-receiving recesses 44 disposed in spaced relation. An edge of the opposing second marginal perimeter portion 24 defines at least one projecting lug 46 configured for mating reception by the lug-receiving recess 44. In the illustrated embodiment, the second marginal perimeter portion 24 defines a plurality of projecting lugs 46 in spaced-relation.

In the illustrated embodiment, the first and second marginal perimeter portions 22, 24 each define a plurality of alternating lug-receiving recesses 44 and projecting lugs 46. Further, the alternating lug-receiving recesses 44 and projecting lugs 46 in the first marginal perimeter portion 22 are off-set relative to the alternating lug-receiving recesses 44 and projecting lugs 46 in the second marginal perimeter portion 24, so that a lug-receiving recess in the first marginal perimeter portion opposes a projecting lug in the second marginal perimeter portion.

A plurality of the anti-fatigue tiles 10 gainfully join together to form an area-covering mat. The tiles 10 interconnect by the lug-receiving recess 44 of a first one of the laminated anti-fatigue tiles 10 matingly receiving a projecting lug 46 of a second one of the laminated anti-fatigue tiles. The tiles 10 thereby connect together to form a single connected mat for covering a large area, such as a room or to form a runner of the tiles for a hallway or aisle.

The lug-receiving recess 44 and the projecting lug 46 as illustrated have dovetail shapes for mating connection thereof. In the illustrated embodiment, the recess 44 and the lug 46 cooperatively define arcuate opposing ends. The lug-receiving recess 44 defines concave arcuate ends 48 while the lug 46 defines convex or outwardly bowed arcuate ends 49. In an alternate embodiment (not illustrated), the lugs 46 define tapered opposing flags that are generally narrower than a circumference that defines the arcuate ends 48 of the recess 44 to facilitate the mating connection of the recess and the lug.

Further, the tile 10 in the illustrated embodiment has an orientation that facilitates mating engagement with other tiles, as discussed below. The tile 10 accomplishes the orientation with a projecting male element 50 on a corner 51 and an opposing female receiving element 52 on an opposing corner 53. The projecting element 50 is defined by the adjacent arcuate ends 49 on the corner 51, which ends 49 are residual portions of a respective projecting lug 46 on a first side 54 and a second side 55 normal to the first side. The receiving element 52 is defined by the adjacent arcuate ends 48 on the corner 52, which ends 48 are residual portions of the land adjacent a respective recess 44 on a third side 56 and a fourth side 57 normal to the third side. The alternate opposing corners 58, 59 combined the residual portions of one end 48 and one end 49 for the end lug 46 and end recess 44 at the respective corner. An alternate embodiment of the tile 10 lacks the orienting projecting elements 50 and receiving element 51, and rather has the combined ends 48, 49 of the recess 44 and end projecting lug 46 on the respective sides normal to each other.

Figure 3:
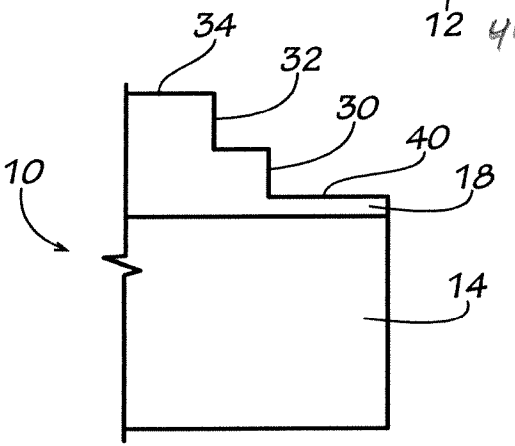
FIG. 3 illustrates in cross-sectional view the modular floor tile taken along line 3-3 of FIG. 2.

FIG. 3 illustrates in cross-sectional view features of the rubber/foam-backed laminated tile 10 taken along line 3-3 of FIG. 2. The foam substrate 14 provides a cushion backing for the tile 10 to rest on a floor surface. The rubber layer 18 laminates by vulcanization to the foam substrate. The perimeter portions 22, 24 define the land 40 that is recessed relative to the support surfaces 34 of the cleats 32 extending from the land 30. The perimeter portions 22, 24 define the lug-receiving recesses 44 and lugs 46 for connecting adjacent tiles 10.

Figure 4:
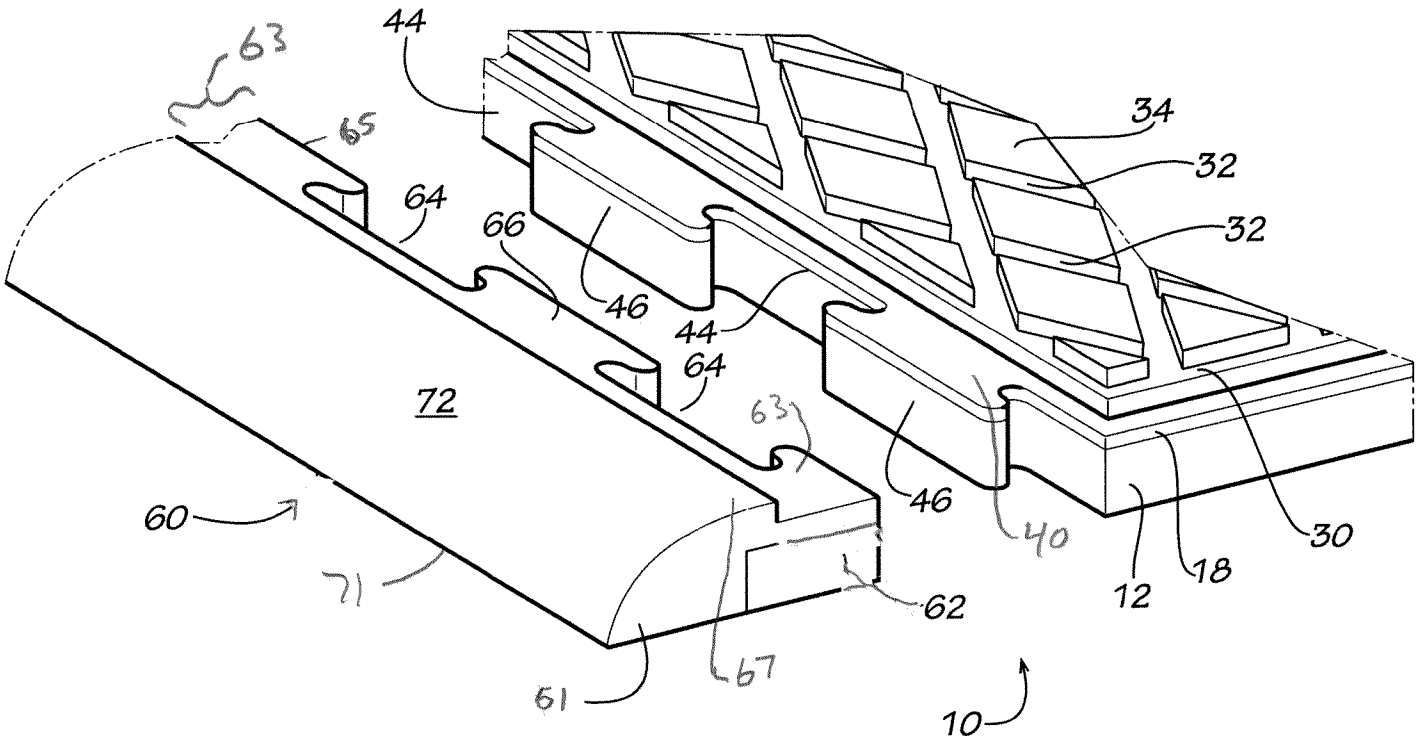
FIG. 4 illustrates a perimeter band member selectively attachable to the edge of the modular floor tile to define a tapered side edge trim surface for the tile or for a mat having a plurality of interconnected tiles.
Figure 7:
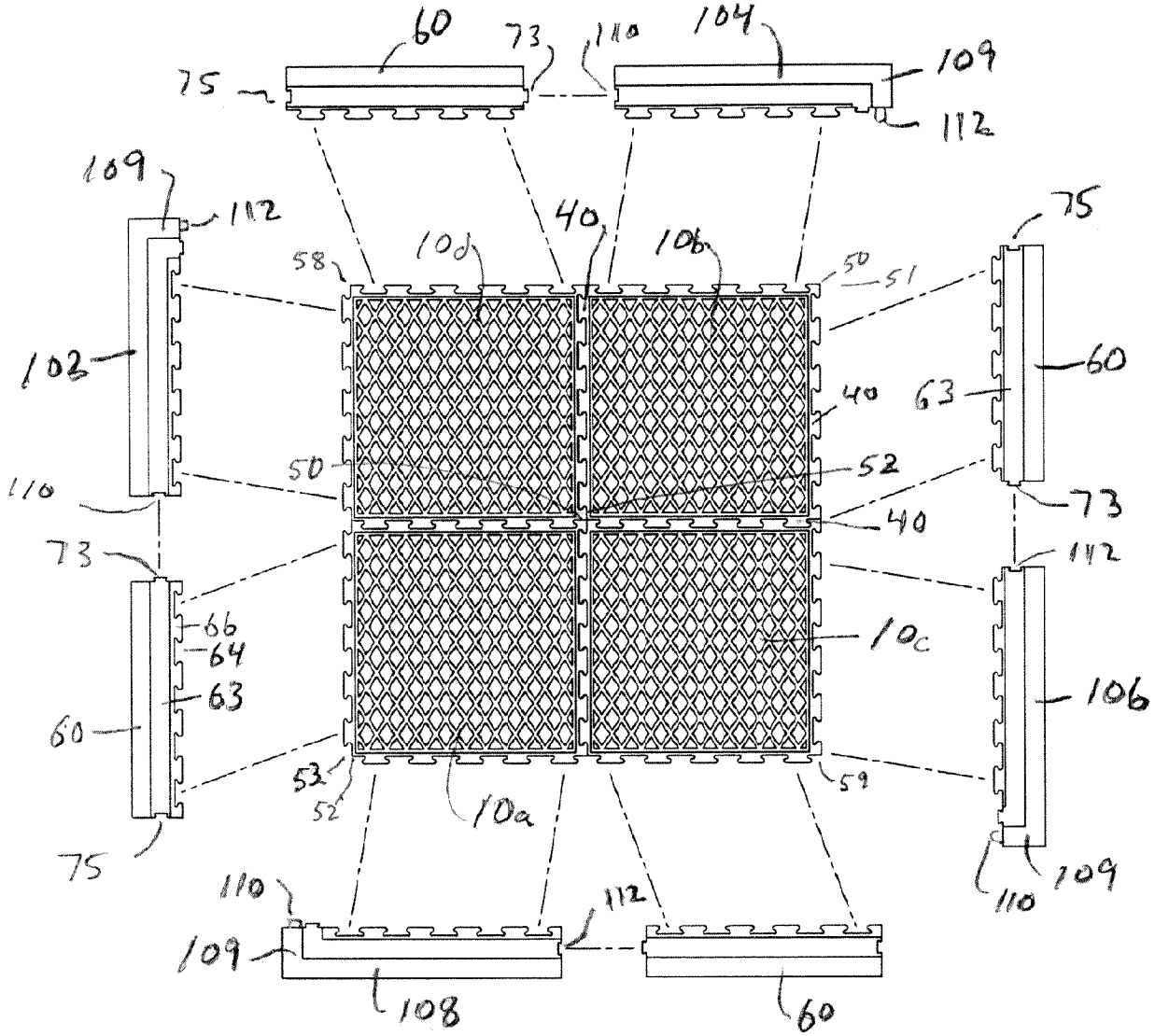
FIG. 7 illustrates a plurality of tiles connected together to define a mat with perimeter band members that define side edge trim for the mat.

FIG. 4 illustrates an elongated perimeter band member 60 selectively attachable to one of the marginal perimeter portions (22, 24, 26, or 28) as appropriate to define a finished edge for the tile 10 or for an assembly of a plurality of the tiles 10 to cover a large area. The elongated band member 60 includes a rubber layer 61 that attaches during vulcanization to a foam pad 62. The member 60 includes an edge portion 63 with a surface and a lateral edge 65. The lateral edge 65 is configured for being engaged to a respective perimeter portion 22, 24, 26, or 28. To that end, the edge 65 defines (i) at least one projecting lug 66 configured for being received by the lug-receiving recess 44 in a respective marginal perimeter portion or (ii) at least one lug-receiving recess 64 configured for receiving the projecting lug 46 of a respective marginal perimeter portion. The edge 65 in the illustrated embodiment includes alternating lug-receiving recesses 64 and lugs 66 for aligned mating attachment to a respective marginal perimeter portion 22, 24, 26, or 28 of the tile 10. The member 60 includes a support surface 67 on an extending portion lateral of the edge portion 63. The surface 63 is recessed relative to the support surface 67. The thickness of the edge portion 63 equals that of the land 40 of the tile 10 for cooperative horizontal alignment of the surfaces of the edge portion 63 and the land 40. Similarly, the support surface 67 extends above the edge portion 63 a distance equal to the support surface 34 relative to the land 40. The thickness of the band member 60 tapers from the support surface 67 laterally as a sloped surface 72 to a lateral edge 71. As illustrated in FIG. 7, the edge portion 63 defines in one end of the band member 60 a projecting lug 73 and in an opposing end defines a recess 75.

It is to be appreciated that the tapered edges on two opposing sides may be molded and formed into the tile 10 such as during the vulcanization molding process for a tile having the two opposing marginal portions 22, 24, for example, for forming a fixed width tile such as for a runner.

Figure 5:
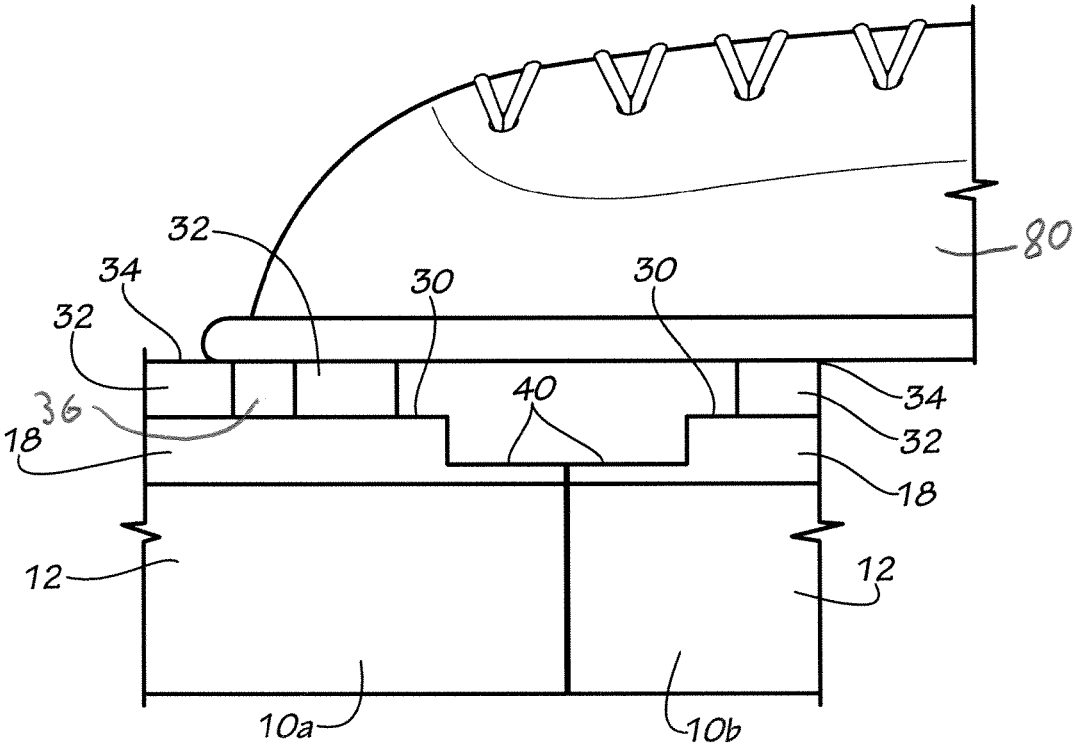
FIG. 5 illustrates a detailed cross-sectional view of a pair of the floor tiles connected together and in use with footwear of a user supported away from the connection of the adjacent tiles.

FIG. 5 illustrates a detailed cross-sectional view of a pair of the rubber/foam-backed laminated tiles 10*a*, 10*b* connected together as a mat and in use for covering a floor surface. The support surfaces 34 of the cleats 32 support, for example, wheeled traffic or as illustrated, footwear 80, of a user vertically spaced and remote from the lug/recess connections in the land 40 of the marginal perimeter portions 22 (or 24, 26 or 28) of the adjacent tiles 10. In the illustrative embodiment, the surface of the second land 40 is recessed ⅛ inch vertically below the support surface 34. Other vertical spacing may be satisfactory. The support surfaces 34 and the recessed land 40 cooperatively restrict the footwear 80 (or wheeled traffic) from scuffing against the upper edges or portions of the rubber layer at the joined connection of the projecting lugs 46 received in the recesses 44, so that the rubber layer 18 is not delaminated from the foam substrate 14. With reference to FIG. 4, the support surface 67 of the band member 60 on the side of the tile 10 aligns horizontally with the support surface 34 on the tile. The recessed surfaces of the edge portion 63 and the land 40 align for recessing the connection of the recesses 44 and lugs 66 and of the lugs 46 and recesses 64.

Figure 6:
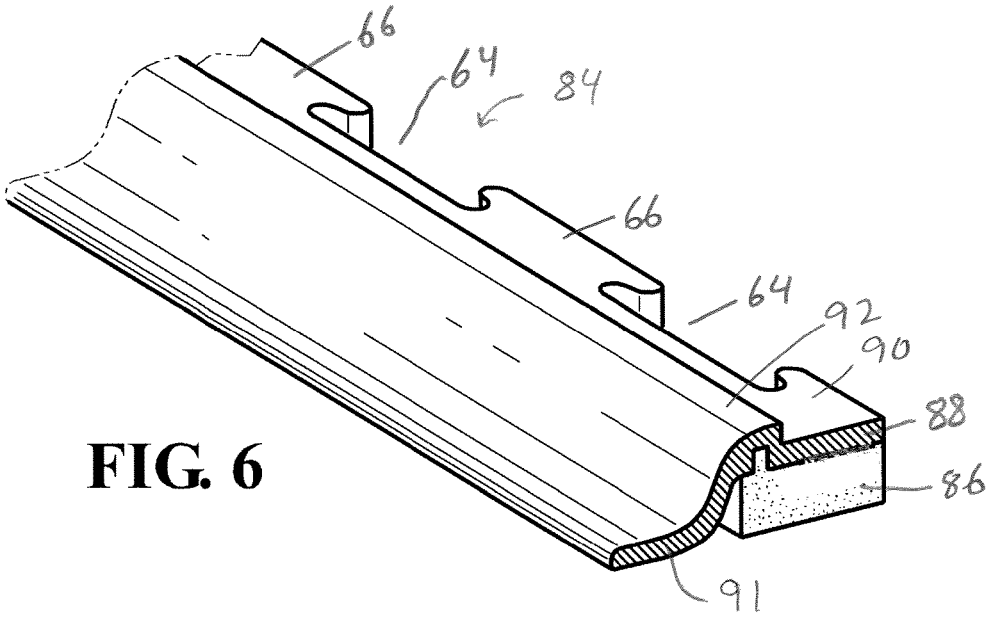
FIG. 6 illustrates an alternate embodiment of a perimeter band member for selectively attaching to the edge of the floor tile to define a tapered side edge trim surface for the tile or for a mat having a plurality of interconnected tiles.

FIG. 6 illustrates in perspective view a perimeter band member 84 as an alternate embodiment defining a trimming side edge of the tile 10 or of a mat of connected tiles. The member 84 includes a foam base 86 and rubber layer 88 that defines a surface 90 and raised support surface 82. A portion 91 of the rubber layer 88 extends laterally such as a tongue or a tapered flap along a side edge of the tile 10. The portion 91 provides a transition between a floor surface and the tile 10. An edge of the member 84 defines the alternating recesses 64 and lugs 66, as discussed above, for connecting the member 84 to the tiles 10.

An alternate embodiment of the perimeter band member lacks the tapered portion 91, and rather, defines a squared-off lateral edge. The trim member of this alternate embodiment is useful for defining an edge of mat disposed on an aisle that does not have cross traffic across the mat, such as between opposing storage shelves, and not requiring a sloped entry to the mat.

FIG. 7 illustrates a top plan view of four tiles 10 connected together by interconnecting opposing recesses 44 and lugs 46 to define an area mat 100. The land surfaces 40 between adjacent tiles are recessed relative to the support surfaces 34. The outer side edges of the area mat 100 are finished with respective trim band members 60 (or 84) discussed above and with corner edge members 102, 104, 106, and 108. Corner edge members 102, 104 and band members 60 are shown exploded from the sides of the tiles to which they connect. The corner edge members 102, 104, 106, and 108 are structurally the same as the band member 60 (or 84), but a distal end portion generally 109 of each defines a 90° lateral bend to define the corner. In the illustrated embodiment, the corner edge members 102, 104, 106, and 108 terminate at the bend portion with a projecting lug 110 in the edge portion 63. An opposing distal end defines a recess 112 in the edge portion 63. The lug 110 and the recess 112 are structurally the same as the lug 73 and the recess 75 for interlinking with band members 60. The lug 110 matingly connects to the recess 75 of the band member 60; the recess 112 receives the lug 73 of another of the band members 60. For larger area mats, additional band members 60 are used. In this way, a perimeter border for the area mat 100 assembles from the four corner edge members 102, 104, 106, and 108, and two of the side bands 60. It is to be appreciated that the alternating recesses 64 and projecting lugs 66 in the members commence with either a recess or a lug, for mating connection to a respective side of the tile 10.

As discussed above with reference to FIG. 1, the projecting element 50 on the corner 51 of a tile 10*a* abuts the receiving element 52 on the corner 53 of an adjacent tile 10*b*. The combined ends 48, 49 on the alternating corners 58, 59 of the tiles 10*c*, 10*d*, respectively, abut the adjacent corners 51, 53 as illustrated in FIG. 7.

Figure 8:
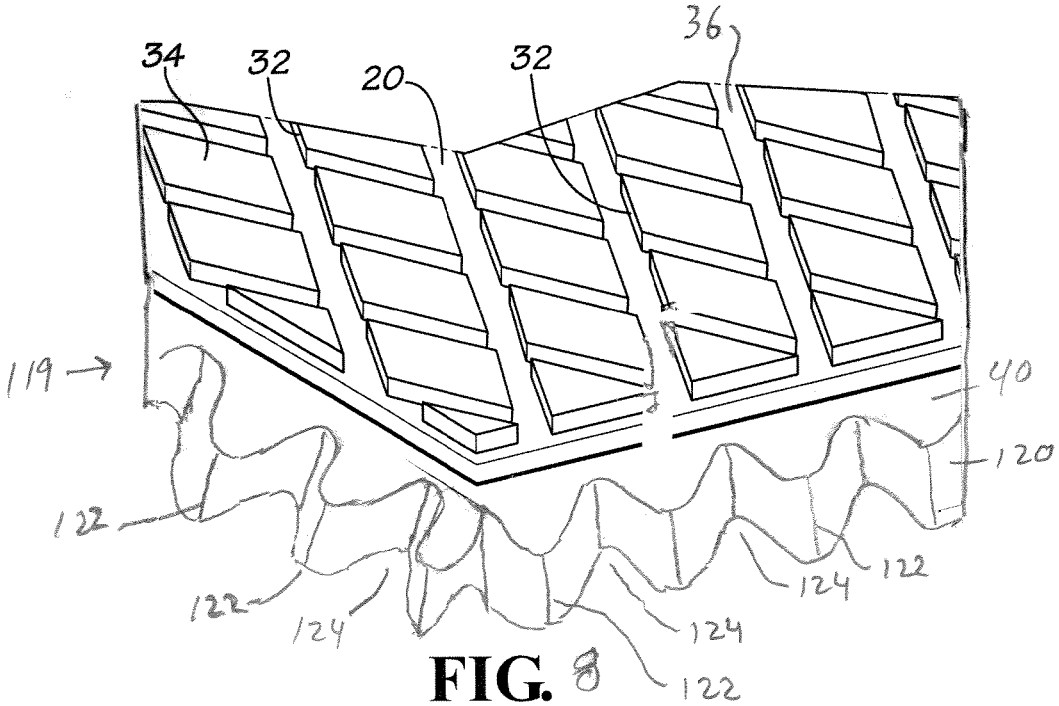
FIG. 8 illustrates a detailed perspective view of a portion of an alternate embodiment of a modular floor tile.

As explained above, the marginal perimeter portions 22, 24, 26 and 28 define the surface 40 recessed relative to the support surface 34. A pair of tiles 10 connect on adjacent perimeter portions. FIG. 8 illustrates a portion of an alternate embodiment 119 of the tile 10. The marginal perimeter portions of the tile 119 define sawtooth edges 120 of projecting points 122 and recesses 124. A pair of the tiles 119 matingly connect on the opposing sawtooth edges 120. To maintain alignment of tiles in a mat of adjacent tiles, one perimeter edge commences with a point 122 and an opposing perimeter edge the point is off-set in order to be received by the opposing aligned recess 124 in the adjacent tile. In an alternate embodiment, the sawtooth edge 120 is curved, arcuate, or sinusoidal, for mating abutment of perimeter portions of adjacent tiles 10. Similarly, the perimeter band members 60, 84 may gainfully use the sawtooth edge 120 for joining an adjacent sawtooth edge perimeter portion of the tile.

Figure 9:
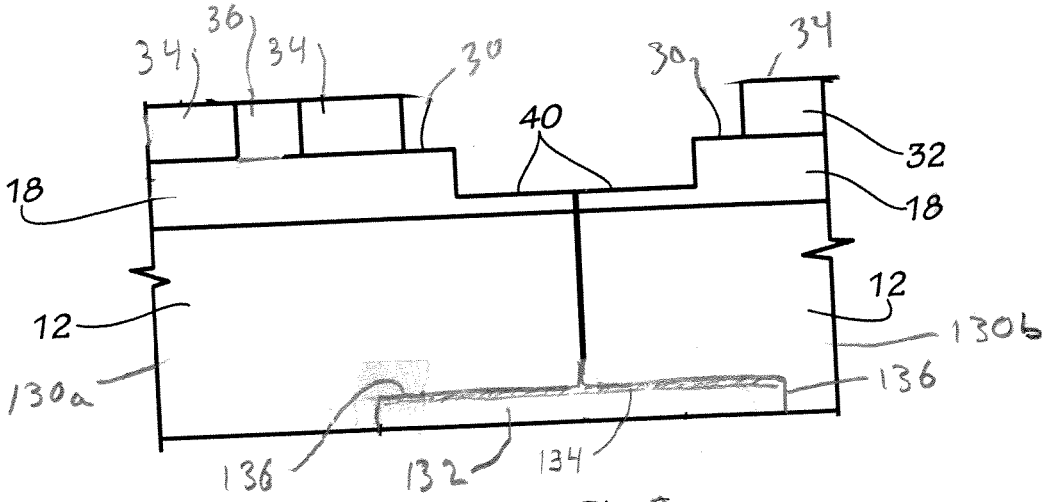
FIG. 9 illustrates in cross-sectional view a pair of modular floor tiles in an alternate embodiment.

FIG. 9 illustrates an alternate embodiment tile 130 in which the perimeter portions 22, 24, 26, and 28 have an elongated strip 132 as a connector for joining abutting perimeter portions of adjacent tiles. The elongated strip 132 has an adhesive surface 134 such as a tape, for adheringly overlapping areas of the adjacent surfaces of the perimeter portions of the tiles. In the illustrated embodiment of the tile 130, the back surface defines a recessed channel 136 which receives the adhesive strip 132. The strip 132 overlaps the perimeters of the adjacent tiles 130. The adhesive strip 132 may similarly be adhered on the surfaces 40 overlapping the joint between the adjacent tiles 130*a*, 130*b*. Similarly, the perimeter band members 60, 84 may gainfully connect to the perimeter portion of an adjacent tile using the adhesive strip 132.

Figure 10:
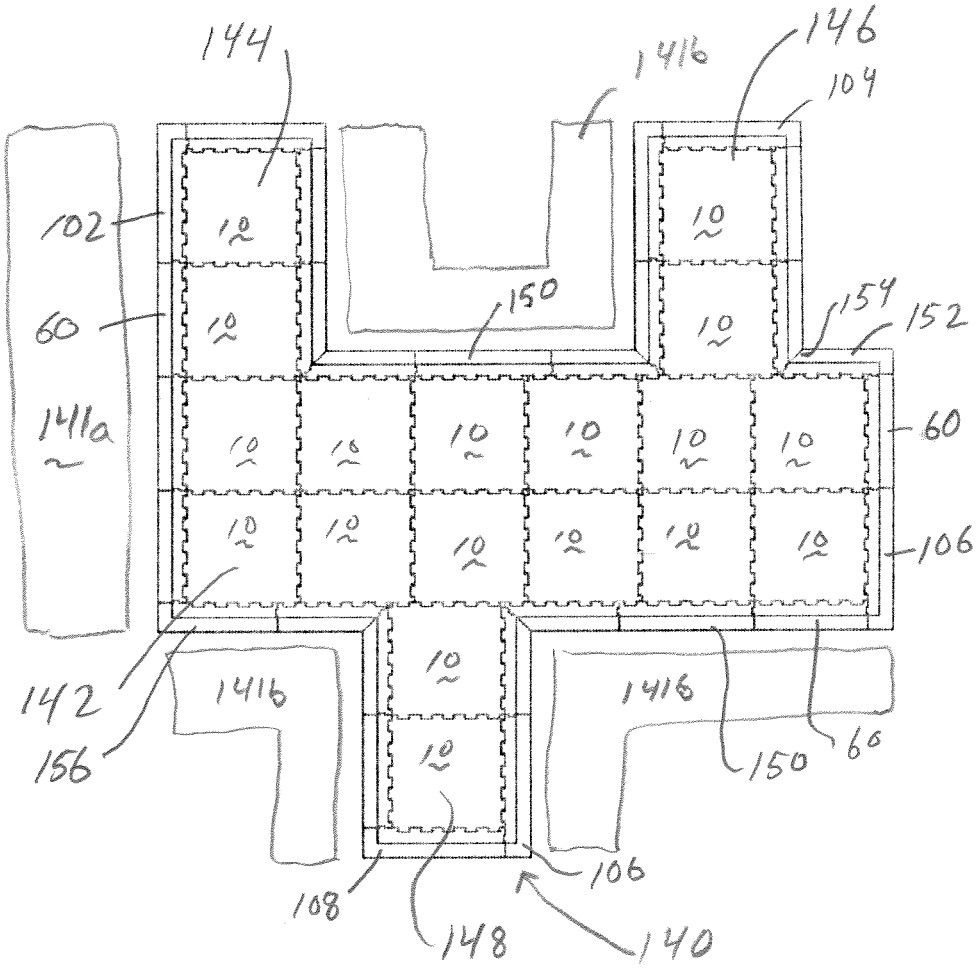
FIG. 10 illustrates a plan view of a floor mat assembled from a plurality of tiles and side-edge trim members customized for a particular facility as an illustrative application of the present invention.

FIG. 10 provides an illustrative example of a custom mat 140 for covering a floor area in a particular facility installation, for example, a prescription fulfillment area of a drugstore having a counter area 141*a* and shelves 141*b* from which stock may be obtained. To facilitate standing during work, the floor area is provide with an anti-fatigue 140 that assembles from a plurality of the tiles 10 and the side trim edge members (60, 84, 012, 104, 106, and 108) discussed above. The mat 140 has a main area 142 and three (3) stems 144, 146, 148 extending from the main area. In this illustration, the stem 146 is offset relative to the tiles 10 from which the stem 146 extends. Similarly, the stem 148 is offset relative to the tile from which it extends. To accommodate such offset, custom length side trim members are required. These include a special length straight side member 150, a corner end member 152 having a 45° (mitered) end 154 defining a portion of a bend in the perimeter of two joined tiles 10, and a corner member 156 with a 90° bend defining a normal corner. The straight side member 150 is longer than a standard straight side member 60, but may be shorter as appropriate for a particular custom installation. The corner member 154 is shorter in length than a standard corner member 106, but may be shorter as appropriate for a particular custom installation.

The tile 10 in the illustrated embodiment is manufactured from sheets of foam and rubber sized for the particular tile. With reference to FIGS. 1 and 2, a sheet or substrate of foam 12 is placed in a vulcanizing mold. The rubber layer 18 is overlaid on the foam substrate 12. The mold defines the central portion 20 with the cleats 32 as well as the marginal perimeter portions 22, 24 (and in the illustrated embodiment 26, 28) with the second lands 40 recessed relative to the support surfaces 34. During the vulcanization heat and pressure process, the rubber layer 18 conforms to the mold definitions for the central portion and the perimeter portions and laminates to the foam substrate 12 opposing the back surface 16.

The blank of the vulcanized rubber/foam floor tile is removed from the mold and placed on a cutting apparatus for cutting marginal portions of the blank away by forming the lug-receiving recesses 44 and projecting lugs 46 on the marginal perimeter portions. The cutting tool is preferably a water-jet apparatus. The water jet operates as a cutting blade to cut through the rubber and foam layers. The water-jet cuts through the laminated tile 10 without compressing the foam substrate 12. Other cutting devices that apply a pressure or load to the tile during the cutting process compresses the foam. The compressed foam bulges outwardly, which bulge is then cut by the cutter. When the compression is released, the foam retracts, and the cut-off portion of the foam forms a cavity or cup in the side wall of the laminated tile. Side walls with such cavity or cup are unsatisfactory, as resulting in weakened lug-receiving recesses and lugs, such that an assembly of tiles 10 are insufficiently joined together to resist separation under foot or wheeled traffic. In the illustrated embodiment, the lug-receiving recesses 44 and the projecting lugs 46 are cut from the surface of the second land 40 through the foam depth 14. An alternate embodiment may cut less than through the entire thickness, and with a lateral cutting device, separate a plug and leave a shelf extending from the side wall.

The method described above may gainfully be followed to manufacture a plurality of the tiles 10 simultaneously. The foam substrate 12 and the rubber layer 18 are sized for the number of tiles 10 to be cut from laminated blank. The discrete tiles 10 are separated from the laminated blank by simultaneously forming the lug-receiving recess 44 for a first of the plurality of anti-fatigue tiles and the projecting lug 46 for a second of the plurality of anti-fatigue tiles adjacent to the first anti-fatigue tile. This is accomplished by a cut line made by the water-jet, by which the adjacent anti-fatigue tiles are separated one from another.

The edge members 60, 84, 102, 104, 106, and 108, are similarly manufactured in a respective mold by vulcanizing a rubber layer to a foam member.

The special length edge members 150, 152, and 154, for example, may likewise be defined in the blank and cut apart with the water-jet.

The floor tile 10 of the present invention is disclosed in an illustrative embodiment as having a base substrate 12 of a foam material or sheet and the top layer 18 of a rubber sheet that upon vulcanization attaches to the foam while forming the structure of the central portion and the perimeter portions, whereby the feature of the perimeter portions 22, 24 (and 26, 28) having the mating recesses and projections 44, 46 with the surface 40 recessed relative to the support surface 34, facilitates the tiles joined together to form the mat and to resist delamination of the top layer and the base substrate during use of the mat. It is to be appreciated that layered tiles may gainfully be made of conventional mat materials and include the features of the present invention. This includes vinyl sponge tiles of a vinyl layer attached to a PVC foam (closed or open cell), in various thicknesses for selective cushioning, rubber top surface or layer that is heat bonded to PVC foam base (open cell or closed cell), PVC or other resilient sheet members attached, heat-bonded, fusion-bonded, adhered such as with an adhesive, glue, or joining material, laminated or otherwise connected to a base cushioning substrate such as foam, urethane sponge layers (such as providing highly resistant cushioning), the base substrate formed by curing a liquid foam material that adheres to the top layer, as well as other conventional materials that may be layered together to form a floor tile. Such tiles may gainfully apply the feature of the surface on perimeter portions recessed relative to the support surface 34 on which a user walks to resist delamination of the layers of the tile during use. The edge members 60, 84, 102, 104, 106, and 106, are similarly manufactured.

FIG. 5 illustrates a portion of two adjacent joined tiles 10*a*, 10*b*, with footwear 80 supported on the support surfaces 34 for use as an anti-fatigue mat covering an area on a hard floor surface. The footwear 80 of a user is kept vertically spaced and remote from the lug/recess connections in the second land 40 of the marginal perimeter portions 22 (or 24, 26 or 28) of the adjacent tiles 10. The support surfaces 34 and the recessed land 40 thereby cooperatively restrict the footwear 80 (or wheeled traffic) from scuffing against the upper edges or portions of the rubber layer at the joined connection of the projecting lugs 46 received in the recesses 44, so that the rubber layer 18 is not delaminated from the foam substrate 14.

The channels 36 may allow flow of water from the tile, for wet environments. Also, an alternate embodiment may define a plurality of through holes.

With reference to FIG. 7, a plurality of the tiles 10 readily connect to define the area mat 100. Corner edge members 102, 104, 106, and 108 interconnect with side members 60 and with respective edges of the tiles 10 to define a perimeter trim for the area mat 100.

With reference to FIG. 8, adjacent tiles 119 matingly connect on perimeter portions by receiving points 122 in recesses 124.

As shown in FIG. 9, adjacent tiles in an alternate embodiment attach together with the adhesive strip 132.

The tile 10 in the illustrated embodiment is 18×18 inches square, with a foam substrate 12 of ⅝ inches, and a rubber layer of ⅛ inch. The recessed land 40 has a width of 1 inch. The recesses 44 and projecting tabs 46 are on 3½ inch centers, permitting incremental 3½ inch offsets for stems extending from a mat, as discussed above. The tile 10 however may be formed in selected other sizes, such as may be conventional in the art, with the base and top layers of selected thickness suitable for the particular application for a floor mat, and differences in center spacing for the recesses and projecting tabs.

The present disclosure accordingly describes alternate connectors (mating recesses and projections, adhesive tape, and the like) for joining perimeter portions of adjacent tiles to define the area mat while the support surfaces 34 keep footwear of a user (and wheels of rolling devices) vertically spaced and remote from the second land 40 of the marginal perimeter portions of the adjacent tile. The support surfaces 34 and the recessed land 40 thereby cooperatively restrict the footwear (or wheeled traffic) from scuffing against the upper edges or portions of the top layer at the joined connection of the perimeter portions so that the top layer 18 is not delaminated from the base substrate 14.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

What is claimed is:

1. An anti-fatigue floor tile, comprising:

a base foam substrate with a length and a width exceeding a depth and having a back surface;

a top rubber layer attached by vulcanization to the base foam substrate opposing the back surface, the top rubber layer having a central portion and at least opposing first and second marginal perimeter portions, a plurality of spaced-apart cleats that project from the central portion and each cleat defines a first land with a support surface, the support surface being co-planar with adjacent support surfaces, the first and second marginal perimeter portions each defining a respective second land with a surface recessed relative to the support surface;

the first and second marginal perimeter portions each defining a plurality of dovetail projecting lugs and alternating dovetail lug-receiving recesses for joining a plurality of the floor tiles together as a mat with the dovetail lug-receiving recesses of one of the floor tiles receiving the opposing dovetail projecting lugs of an adjacent second one of the floor tiles, the lug-receiving recesses and the projecting lugs defined in the marginal perimeter portions of the floor tile by water jet without compression of the foam substrate, whereby the walls of the dovetail lug-receiving recesses and the projecting dovetail lugs are substantially planar without cupping, whereby the support surfaces of the top rubber layer of adjacent connected floor tiles support footwear or wheeled traffic of a user thereon remote from the aligned second lands of the adjacent marginal perimeter portions to restrict the footwear or wheeled traffic from scuffing against the joined marginal perimeter portions of the adjacent joined floor tiles so that the top rubber layer is not delaminated from the base foam substrate thereby.

2. The floor tile as recited in claim 1, wherein the dovetail lug-receiving recesses and the dovetail projecting lugs are cut from the surface of the second land through the depth of the base foam substrate.

3. The floor tile as recited in claim 1, further comprising an elongated band member having an upper surface that tapers outwardly to an outward perimeter edge and a lateral land having an opposing edge that defines a plurality of dovetail projecting lugs and alternating dovetail lug-receiving recesses for joining to respective dovetail lug-receiving recesses and dovetail projecting lugs of an adjacent floor tile, the land recessed relative to the upper extent of the upper surface and coplanar with the second land of the adjacent floor tile, the upper surface coplanar with the support surface of the cleats of the adjacent tile, and the thickness of the band member tapering from a thickness equal to that of the floor tile at a connecting edge to a thickness less than the depth of the base foam substrate, to define a sloped surface along an edge of the floor tile.

4. The floor tile as recited in claim 1, further comprising opposing third and fourth marginal perimeter portions that each define a respective second land with a surface recessed relative to the distal support surfaces of the cleats and each define a plurality of alternating dovetail lug-receiving recesses and dovetail projecting lugs.

5. The floor tile as recited in claim 4, wherein the alternating lug-receiving recesses and projecting lugs in the third marginal perimeter portion are off-set relative to the alternating lug-receiving recesses and projecting lugs in the fourth marginal perimeter portion, whereby a lug-receiving recess in the third marginal perimeter portion opposes a projecting lug in the fourth marginal perimeter portion.

6. An area mat, comprising a plurality of modular floor tiles for being joined together selectively to cover an area larger than an individual one of the modular floor tiles, each modular floor tile as recited in claim 1.

* * * * *